US011796187B2

(12) United States Patent
Cowan et al.

(10) Patent No.: US 11,796,187 B2
(45) Date of Patent: Oct. 24, 2023

(54) ELECTRONICALLY CONTROLLED VENT DAMPER

(71) Applicant: Midea Group Co., Ltd., Foshan (CN)

(72) Inventors: Richard W. Cowan, Louisville, KY (US); Felix Conde Zelocuatecatl, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 508 days.

(21) Appl. No.: 16/215,115

(22) Filed: Dec. 10, 2018

(65) Prior Publication Data

US 2020/0182484 A1 Jun. 11, 2020

(51) Int. Cl.

| | |
|---|---|
| ***F24C 15/32*** | (2006.01) |
| ***F23N 3/08*** | (2006.01) |
| ***F24C 15/20*** | (2006.01) |
| ***F23N 5/00*** | (2006.01) |
| ***F24C 3/12*** | (2006.01) |
| ***F23N 3/04*** | (2006.01) |

(52) U.S. Cl.

CPC ..... *F24C 15/322* (2013.01); *F23N 3/085* (2013.01); *F24C 15/2014* (2013.01); *F24C 15/2021* (2013.01); *F24C 15/2042* (2013.01); *F23N 2223/04* (2020.01); *F23N 2223/08* (2020.01); *F23N 2233/04* (2020.01)

(58) Field of Classification Search

CPC ... F23N 3/02; F23N 3/04; F23N 3/042; F23N 3/085; F24C 15/32; F24C 15/322

See application file for complete search history.

(56) References Cited

U.S. PATENT DOCUMENTS

| | | | | | |
|---|---|---|---|---|---|
| 1,301,906 | A | * | 4/1919 | Clark | F24C 1/02 126/36 |
| 1,396,623 | A | * | 11/1921 | Child | F24C 1/02 126/36 |
| 3,051,158 | A | | 8/1962 | Kimberley | |
| 3,423,568 | A | * | 1/1969 | Vonderhaar | F24C 14/02 219/393 |
| 3,624,742 | A | * | 11/1971 | Hurko | F24C 15/2007 126/41 R |
| 3,951,335 | A | * | 4/1976 | Kemp | F24C 15/001 236/45 |
| 4,114,589 | A | * | 9/1978 | Berlik | F24C 15/00 126/21 R |
| 4,240,397 | A | * | 12/1980 | Seidel | F24C 3/128 126/285 B |
| 4,284,235 | A | | 8/1981 | Diermayer et al. | |
| 4,608,961 | A | | 9/1986 | Lanham, Jr. et al. | |
| 4,648,381 | A | | 3/1987 | Ishii et al. | |

(Continued)

FOREIGN PATENT DOCUMENTS

| | | | |
|---|---|---|---|
| CN | 1747776 | A | 3/2006 |
| CN | 101512224 | A | 8/2009 |

(Continued)

OTHER PUBLICATIONS

International Search Report and Written Opinions for application No. PCT/CN2019/118106, dated Jan. 21, 2020.

*Primary Examiner* — Jorge A Pereiro
*Assistant Examiner* — Logan P Jones
(74) *Attorney, Agent, or Firm* — Gray Ice Higdon

(57) ABSTRACT

A system for electronically controlling a vent damper for a gas oven.

16 Claims, 8 Drawing Sheets

(56) References Cited

U.S. PATENT DOCUMENTS

| | | | | |
|---|---|---|---|---|
| 4,739,154 | A | 4/1988 | Bharara et al. | |
| 4,838,481 | A | 6/1989 | Diermayer et al. | |
| 5,500,508 | A | 3/1996 | Gerl | |
| 6,943,322 | B1 * | 9/2005 | Whipple, Jr. | F24C 15/2007 219/400 |
| 7,721,972 | B2 * | 5/2010 | Bracken | F24H 9/20 236/1 H |
| 8,955,506 | B2 | 2/2015 | Murray | |
| 9,115,901 | B2 | 8/2015 | Cadima et al. | |
| 9,427,107 | B2 | 8/2016 | Reinhart | |
| 9,638,428 | B1 * | 5/2017 | Hines, Jr. | F24C 3/008 |
| 2004/0020917 | A1 * | 2/2004 | Sauter | F24C 7/087 219/490 |
| 2005/0247303 | A1 * | 11/2005 | Weiss | F23N 5/242 126/286 |
| 2006/0204911 | A1 * | 9/2006 | Teng | F23N 5/003 431/76 |
| 2007/0221199 | A1 | 9/2007 | Hake et al. | |
| 2010/0227283 | A1 * | 9/2010 | Tanaka | B01D 53/8646 431/2 |
| 2011/0284091 | A1 * | 11/2011 | Livchak | F24C 15/2042 126/299 R |
| 2012/0272946 | A1 * | 11/2012 | Phillips | F24C 15/2007 126/21 R |
| 2013/0025582 | A1 * | 1/2013 | Cadima | F24C 15/001 126/289 |
| 2014/0137429 | A1 * | 5/2014 | Kim | D06F 58/48 34/551 |
| 2016/0109137 | A1 | 4/2016 | Weiss et al. | |
| 2018/0008095 | A1 * | 1/2018 | Bennett | A47J 37/0786 |

FOREIGN PATENT DOCUMENTS

| | | | | |
|---|---|---|---|---|
| CN | 101542201 | A | 9/2009 | |
| CN | 106949502 | A | 7/2017 | |
| CN | 107036133 | A | 8/2017 | |
| CN | 207334728 | U | 5/2018 | |
| DE | 4228913 | A1 * | 3/1994 | F23K 1/04 |
| EP | 2813791 | A1 | 12/2014 | |
| JP | H0538421 | A | 2/1993 | |

* cited by examiner

ELECTRONICALLY CONTROLLED VENT DAMPER

BACKGROUND OF THE INVENTION

Modern gas ovens are all typically equipped with a vent to assure good combustion in the oven chamber by effectively exhausting the products of combustion and promoting the influx of secondary air. In most ovens the vent size is fixed and is sized to accommodate the worst-case combustion scenario that the appliance may be subject to. For example, if an oven is equipped with both bake and broil burners, the worst case (meaning the most venting required) is generally the broil burner. The vent would thus be provided with a minimum size to accommodate the broil burner.

However, sizing an oven vent in this fashion make the oven inefficient during normal operation because an oversized vent causes excessive heat loss and thus thermal inefficiency. This sizing convention also requires additional time for the oven to reach operating temperature. Additionally, in most ovens the gas burner is cycled off and on to maintain a constant temperature. When the oven attains a requisite temperature setting the burner is cycled off, and when it then cools to a predetermined amount below the setpoint the burner cycles back on. As is readily seen, an oversized gas vent will cause the oven to cycle off and on much more frequently, thus causing additional operating expense.

Furthermore, in convection ovens the convection fan can't operate when the gas burner is on because it adversely impacts the gas flame and combustion. Generally, an electric convection element is also used, but it is typically insufficient to maintain the oven cavity temperature during convection. Once the temperature drops below the setpoint, the convection fan must be shut off and the burner is then reignited to bring the oven up to temperature again. Again, with oversized conventional oven vents the operating characteristics of the oven can be quite inefficient since a great deal of heat is lost through the vent.

From the foregoing it can readily be seen that there is a need in the art for a gas oven vent that can be sized to allow the oven to operate efficiently in many different applications, from conventional baking and broiling to convection use.

SUMMARY OF THE INVENTION

The present disclosure is related to systems and apparatus for providing an electronically controlled gas oven vent damper. The system described herein utilizes an electronically or electrically actuated damper that is installed in fluid communication with a vent opening of a gas oven. Additionally, the system provides control logic to operate the vent damper based on a variety of oven use conditions.

In various embodiments, the system disclosed herein provides a damper control that can reduce the effective vent size during the bake "off" cycle. In various embodiments, the system disclosed herein provides a damper control that provides a normal or optimized effective vent size during bake "on" cycles. In various embodiments, the system disclosed herein also provides a damper control that provides a normal or optimized effective vent size during broil "on" cycles. In various embodiments, the system disclosed herein also provides a damper control that reduces the effective vent size during convection burner off cycles. In various embodiments, the system disclosed herein also provides a damper control that reduces the effective vent size during self-cleaning cycles. Additionally, and in further embodiments the system disclosed herein also provides a damper control that increases or maximized the vent opening during and shortly after burner ignition, and then reduce the effective vent opening size thereafter to assist in rapid oven heat up.

In other embodiments, the system and methods disclosed herein may include an electronically controlled vent damper that enables the oven to use both the bake and broil burners simultaneously since it can be opened to provide adequate combustion air for both burners. Additionally, and in some aspects the invention can provide faster pre-heat times since both bake and broil burners can be efficiently operated simultaneously.

As used herein for purposes of the present disclosure, the term "appliance" should be understood to be generally synonymous with and include any device that consumes electrical power and can be connected to an electrical circuit or battery, for example one used in a residential or commercial setting to accomplish work. The appliances referred to herein may include a plurality of electrically operated components powered by the circuit, the components operable by manipulation of control knobs or selectors. The appliances referred to herein may also include a gas supply or source and one or more gas valves for supplying gas to a burner or heating element. The appliance gas valves may be controlled by a selector or knob, either directly or indirectly, and the appliance may also include a processor or processors that operate, control and monitor the appliance and the various components and functions thereof referred to throughout this specification.

The term "vent" is used herein generally to describe various openings and/or passages that communicate between the interior of an oven and the exterior thereof to supply combustion air thereto. A "vent" may be provided in a wide variety of shapes and sizes without departing from the scope of the invention. The term "damper" is used herein generally to describe various apparatus to restrict and/or enhance the effective size of a "vent" and is not limited to one specific apparatus or structure.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred to herein may be operatively connected to the Internet.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. The drawings are not necessarily to scale. Emphasis is instead generally placed upon illustrating the principles of the disclosure, wherein.

DETAILED DESCRIPTION OF THE INVENTION

Referring to drawing FIGS. 1-10, and in accordance with various aspects and embodiments of the invention, a system 10 for an electronically actuated vent damper for an oven 100 is described. In various embodiments the oven 100 in which system 10 is implemented may include a controller 200 integral to oven 100 that operates oven 100 and implements various embodiments and aspects of system 10 as described herein.

Figure 1:
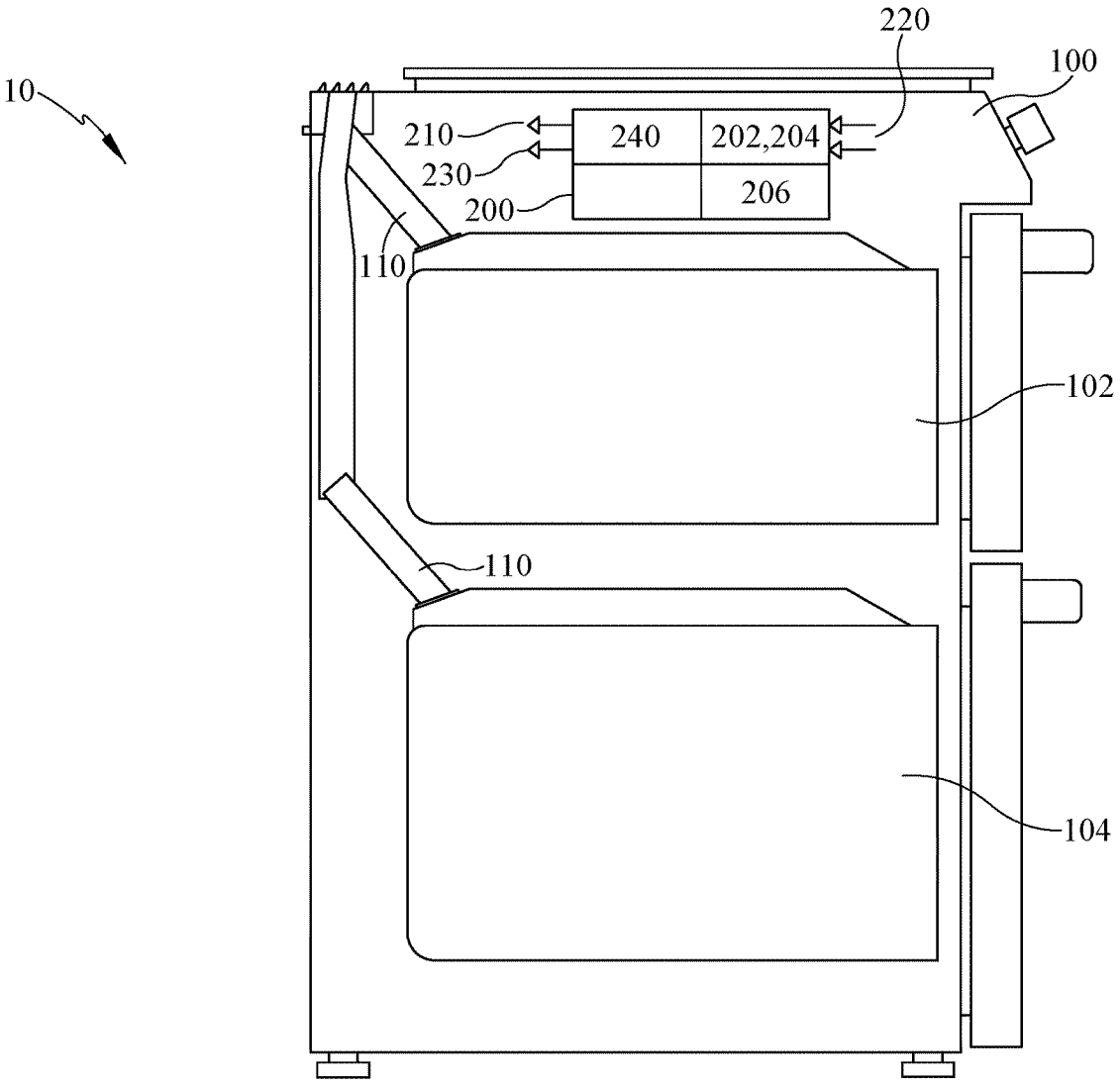
FIG. 1 is a side view of an oven and a control system that may be used in conjunction with the oven in accordance with various embodiments.

FIG. 1 illustrates an exemplary oven 100 and associated hardware for implementing system 10 for an electronically controller vent damper. The system 10 may include a controller 200, a processor or processors 202 and concomitant memory 204. Controller 200 may further comprise a plurality of signal outputs 210 and signal inputs 220 that may be operatively connected to a plurality of oven 1 components to monitor and direct system 10 operation. Furthermore, in some embodiments controller 200 may include a wireless or hard-wired communications interface 230 that enables controller 200 to communicate with external devices or communications networks such as the internet, that may be integrated into system 10.

Additionally, controller 200 may be equipped with an operator or user interface 240 to provide audible or visual feedback to a user as well as provide a user the ability to provide instructions or commands to controller 200. Exemplary but non-limiting user interfaces that may be employed include a mouse, keypads, touch-screens, keyboards, switches and/or touch pads. Any user interface may be employed for use in the invention without departing from the scope thereof. It will be understood that FIG. 1 constitutes, in some respects, an abstraction and that the actual organization of the components of oven 100 and controller 200 may be more complex than illustrated.

The processor 202 may be any hardware device capable of executing instructions stored in memory 204 or data storage 206 or otherwise processing data. As such, the processor may include a microprocessor, field programmable gate array (FPGA), application-specific integrated circuit (ASIC), or other similar devices.

The memory 204 may include various memories such as, for example L1, L2, or L3 cache or system memory. As such, the memory 204 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

The user interface 240 may include one or more devices for enabling communication with a user such as an administrator. For example, the user interface 240 may include a display, a mouse, and a keyboard for receiving user commands. In some embodiments, the user interface 240 may include a command line interface or graphical user interface that may be presented to a remote terminal via the communication interface 230.

The communication interface 230 may include one or more devices for enabling communication with other hardware devices. For example, the communication interface 230 may include a network interface card (NIC) configured to communicate according to the Ethernet protocol. Additionally, the communication interface 230 may implement a TCP/IP stack for communication according to the TCP/IP protocols. Various alternative or additional hardware or configurations for the communication interface 230 will be apparent.

The storage 206 may include one or more machine-readable storage media such as read-only memory (ROM), random-access memory (RAM), magnetic disk storage media, optical storage media, flash-memory devices, or similar storage media. In various embodiments, the storage 206 may store instructions for execution by the processor 202 or data upon with the processor 202 may operate. For example, the storage 206 may store a base operating system for controlling various basic operations of the hardware. Other instruction sets may also be stored in storage 206 for executing various functions of system 10, in accordance with the embodiments detailed below.

It will be apparent that various information described as stored in the storage 206 may be additionally or alternatively stored in the memory 204. In this respect, the memory 204 may also be considered to constitute a "storage device" and the storage 206 may be considered a "memory." Various other arrangements will be apparent. Further, the memory 204 and storage 206 may both be considered to be "non-transitory machine-readable media." As used herein, the term "non-transitory" will be understood to exclude transitory signals but to include all forms of storage, including both volatile and non-volatile memories.

While the controller 200 is shown as including one of each described component, the various components may be duplicated in various embodiments. For example, the processor 202 may include multiple microprocessors that are configured to independently execute the methods described herein or are configured to perform steps or subroutines of the methods described herein such that the multiple processors cooperate to achieve the functionality described herein.

Figure 2:
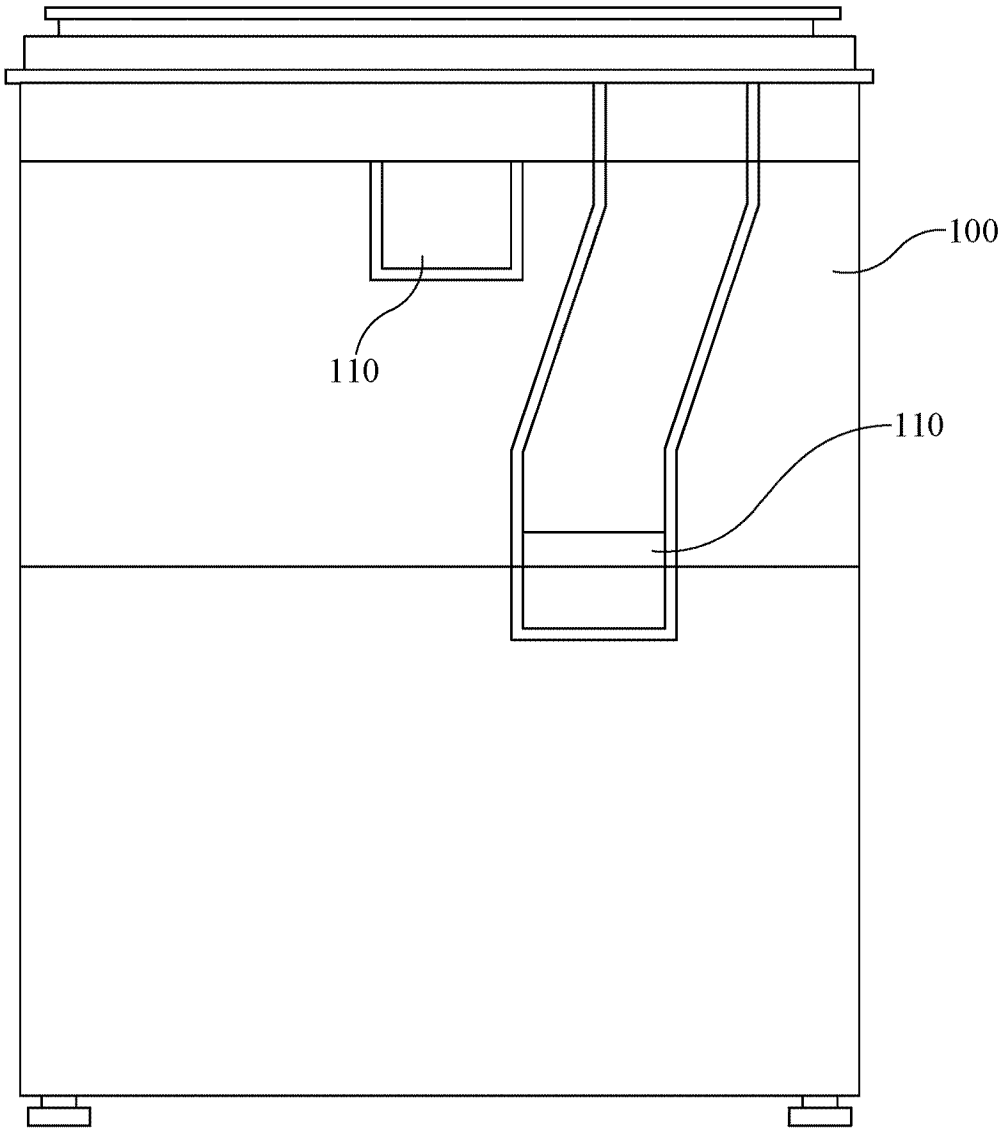
FIG. 2 is a rear view of an oven and vent in accordance with various embodiments.

Referring now to FIGS. 1 and 2, and in accordance with some embodiments, a gas oven 100 may include an upper oven 102 and a lower oven 104. Furthermore, upper oven 102 and lower oven 104 each include a gas vent 110 as normally required to provided venting to a gas-operated oven. It should be understood that any oven 100 or is not required to include upper and lower ovens 102, 104, but that system 10 may operated with any gas oven 100 utilizing a vent 110 without departing from the scope of the invention. For example, in one non-limiting exemplary embodiment for purposes of illustration in this specification, oven 100 may be a conventional gas stove 100 that includes a single oven 102 having a broiler element, (or equivalently a cooktop and oven combination.

Figure 4:
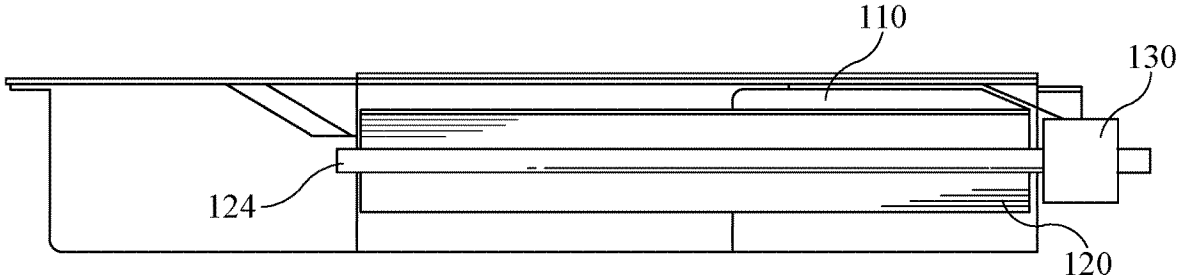
FIG. 4 is a side view of a movable plate damper in accordance with some aspects and embodiments.
Figure 5:
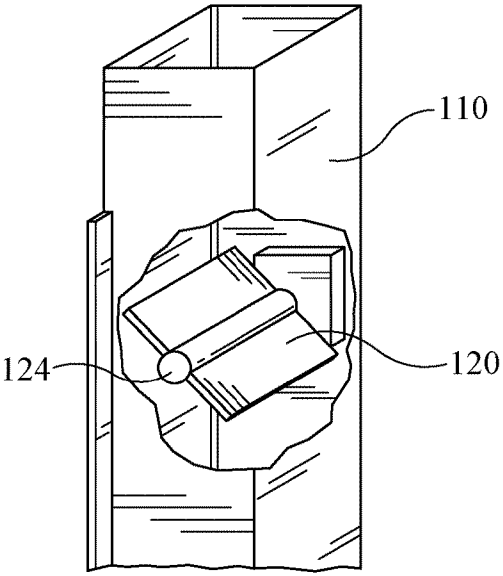
FIG. 5 is an exploded perspective s view of a movable plate damper in accordance with some aspects and embodiments.
Figure 3:
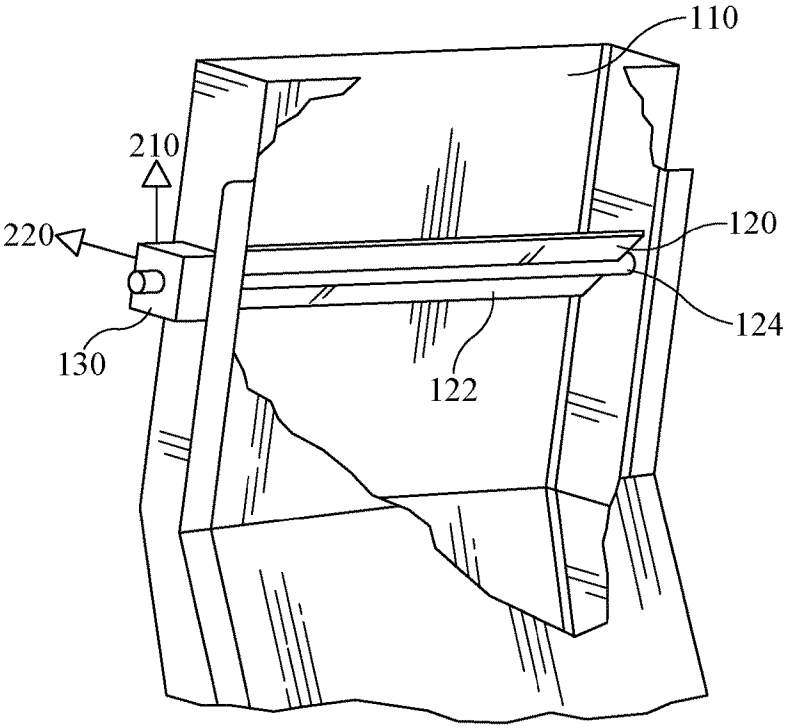
FIG. 3 is a perspective view of movable plate damper in accordance with some aspects and embodiments.

As shown in FIGS. 3-5, in some embodiments system 10 may include a damper 120 mounted inside vent 110 to modify, restrict, or enhance the air flow through vent 110. In the embodiments depicted in FIGS. 3-5 damper 120 is depicted as a movable or rotatable plate 122 that rotates around a central axis 124 and that is controlled by an actuator 130. Actuator 130 may be one of many varied electrically powered actuators, for example a dc motor, stepper motor, a solenoid, or a lock-motor type motor with a cam drive. Actuator 130 may accept an output 210 from controller 200 that provides a signal representative of desired damper 120 position to actuator 130. Furthermore, and in some aspects and embodiments, actuator 130 may provide an output signal to an input 220 of controller 200 that is representative of damper 120 position, thereby providing positive feedback of damper 120 position to controller 200.

Figure 8:
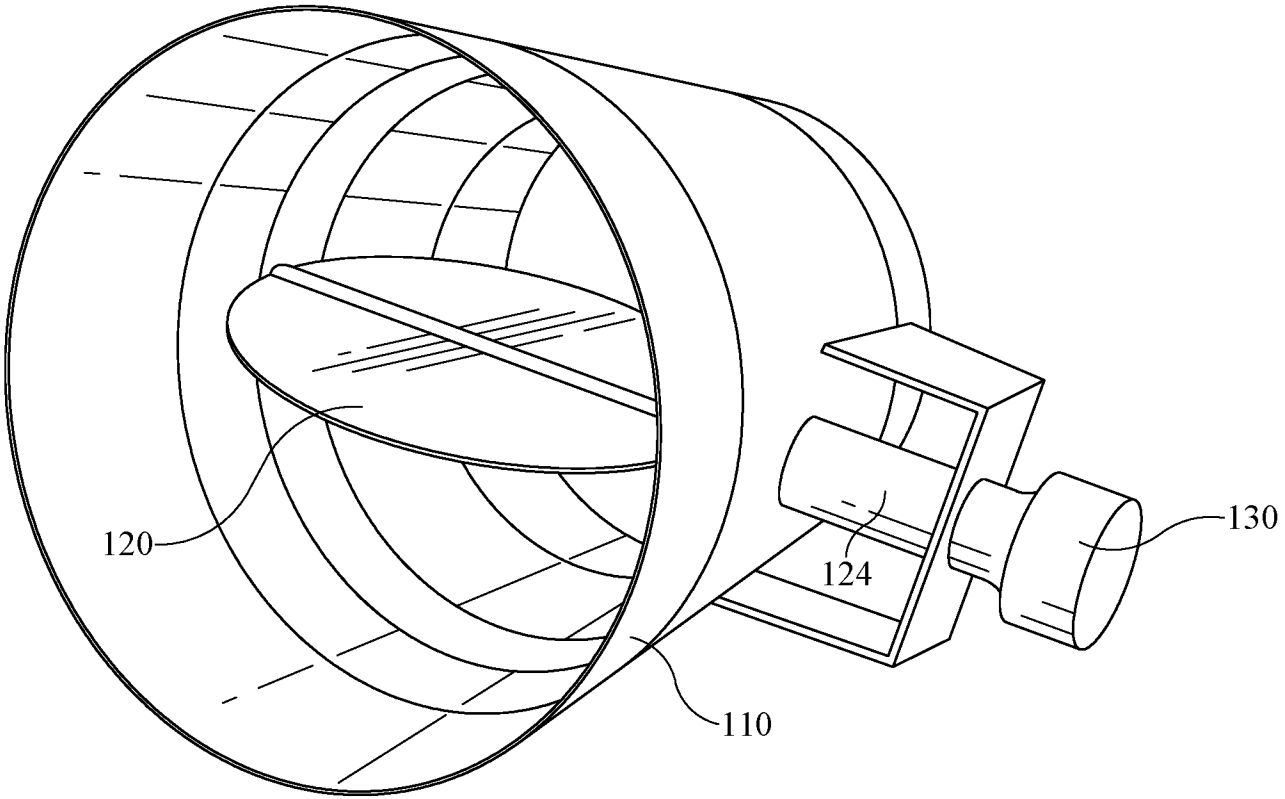
FIG. 8 is a perspective view of a butterfly damper in accordance with some aspects and embodiments.
Figure 9:
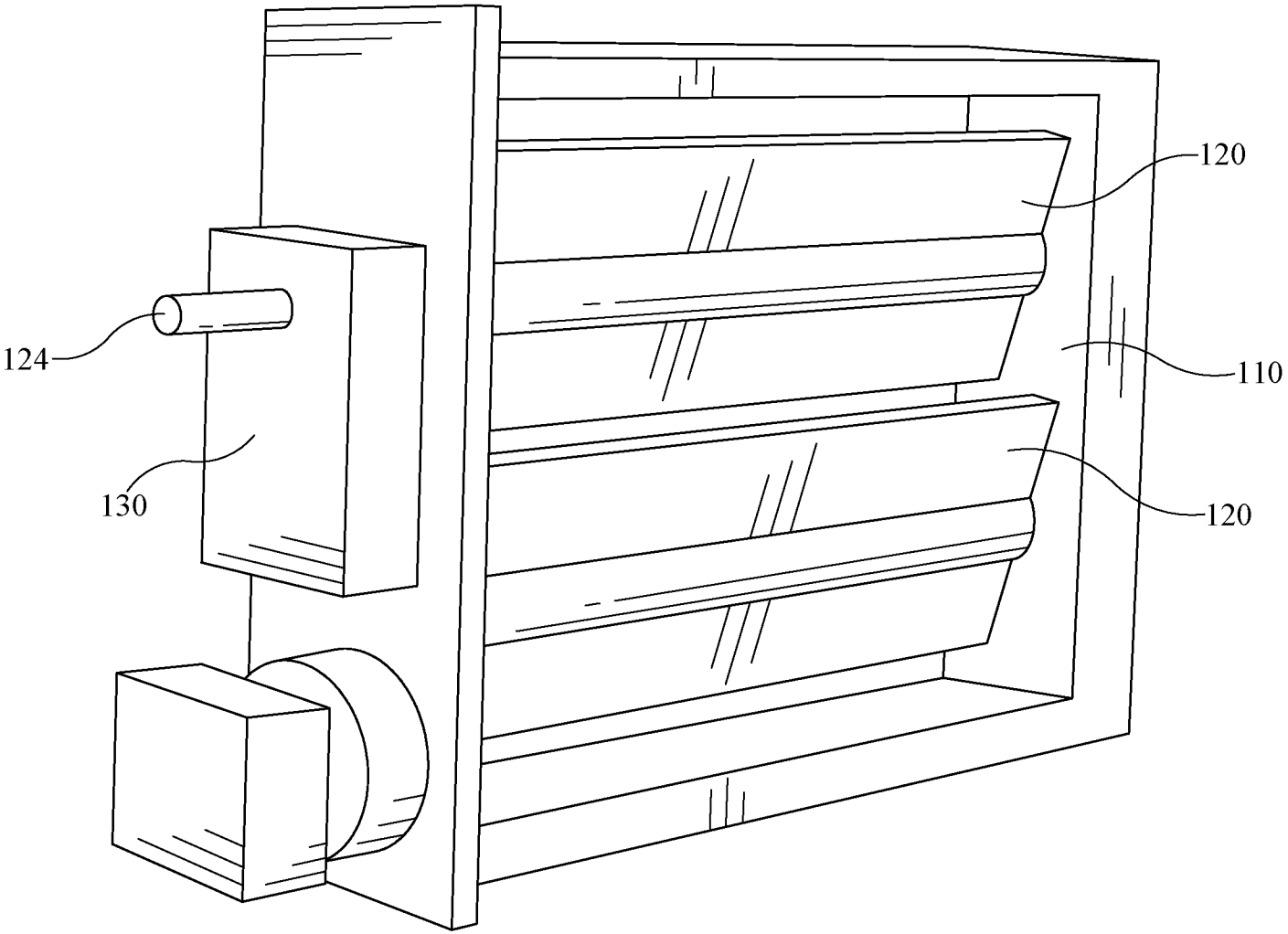
FIG. 9 is a perspective view of a louvered damper in accordance with some aspects and embodiments.
Figure 10:
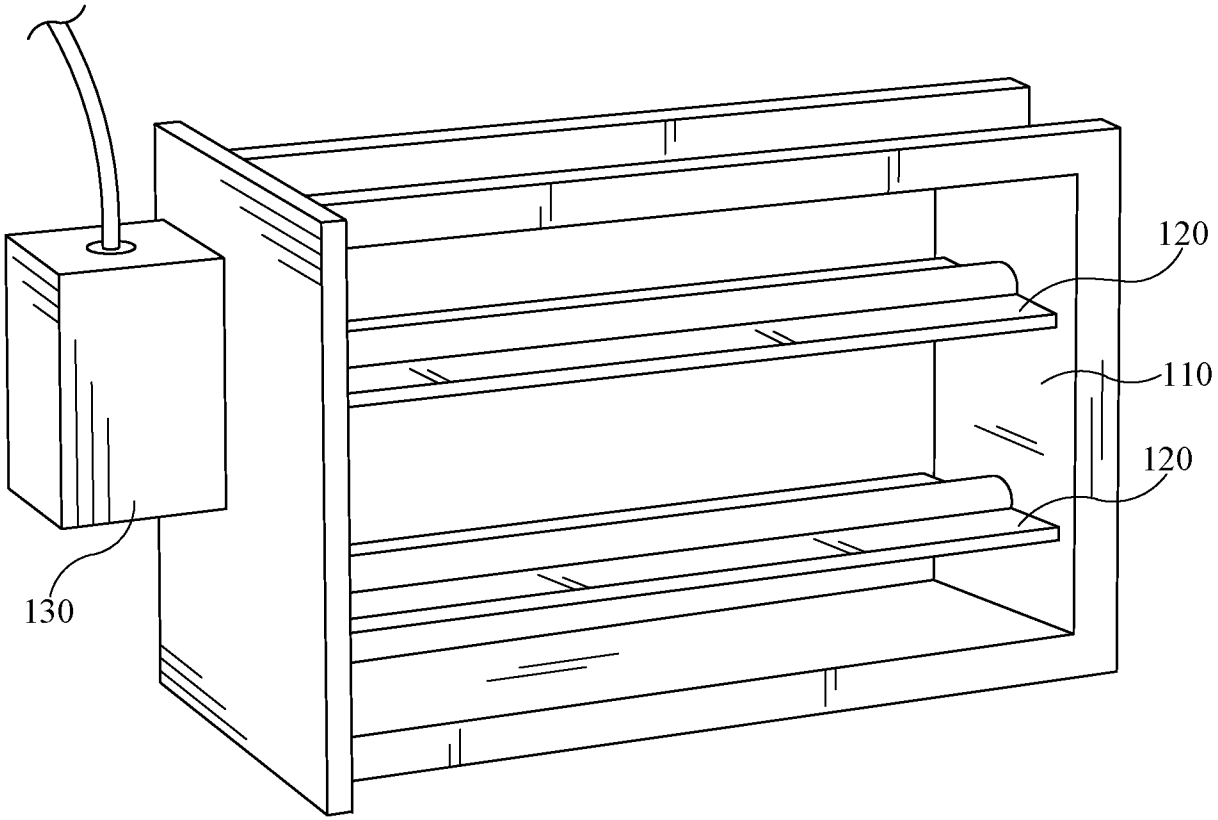
FIG. 10 is a perspective view of a louvered damper in accordance with some aspects and embodiments.

In some aspects and embodiments as best depicted in FIGS. 8-10 damper 120 may be provided as various different structures depending on vent 110 size, cross-section, and configuration. In one exemplary but non-limiting embodiment shown in FIG. 8 damper 120 is depicted as a rotatable circular plate that rotates around a central axis 124. The circular plate damper 120 is sized such that the diameter of the damper 120 is only slightly smaller than the diameter of cylindrical vent 110 so that airflow there through can be restricted.

FIGS. 9 and 10 depict embodiments of a louver-style damper 120 installed in vent 110 that incorporates a plurality of rotating plates 120 controlled by an actuator or actuators 130 to restrict or enhance air flow through vent 110. In some aspects individual rotating plates 120 or louvers may be controlled by individual actuators 130 so that a portion or portions of vent 110 may be completely blocked while another portion permits airflow. In other aspects wherein the louver-style damper is employed individual dampers 120 may be "ganged" together such that actuation of one damper 120 actuates all louvers 120 simultaneously.

In yet another aspect of the invention, actuators 130 may be provided such that power failure to actuator 130 forces actuator 130 to return damper 120 to a fully open position. This feature of the invention provides a measure of safety in the event of a power failure since the oven will be fully vented in any event.

Figure 7:
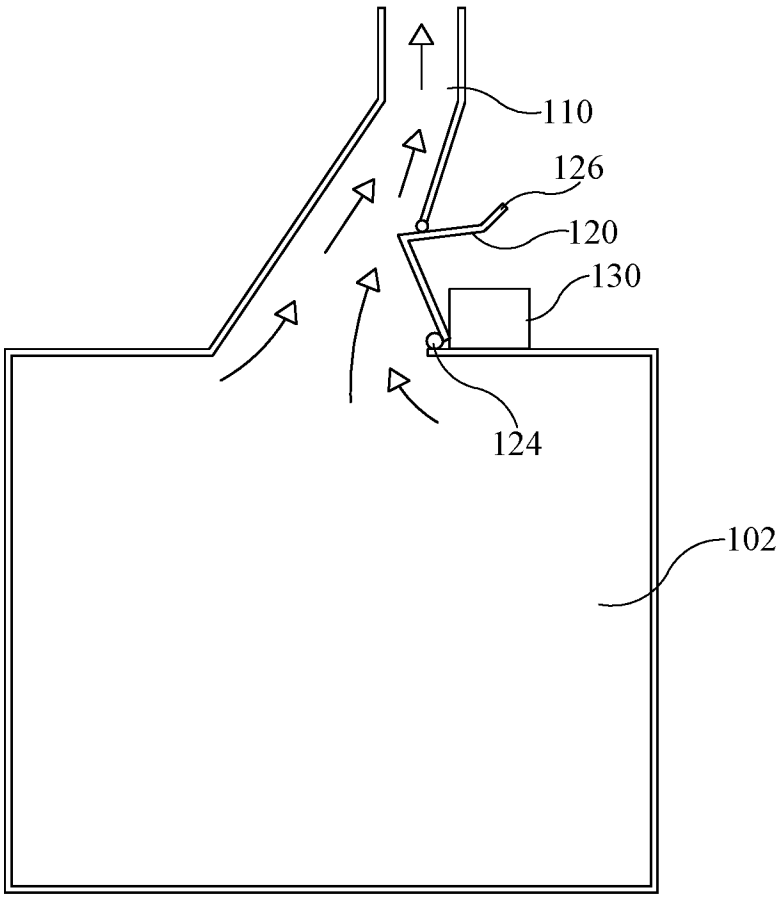
FIG. 7 is side view of a variable flow vent assembly in accordance with some aspects and embodiments.
Figure 6:
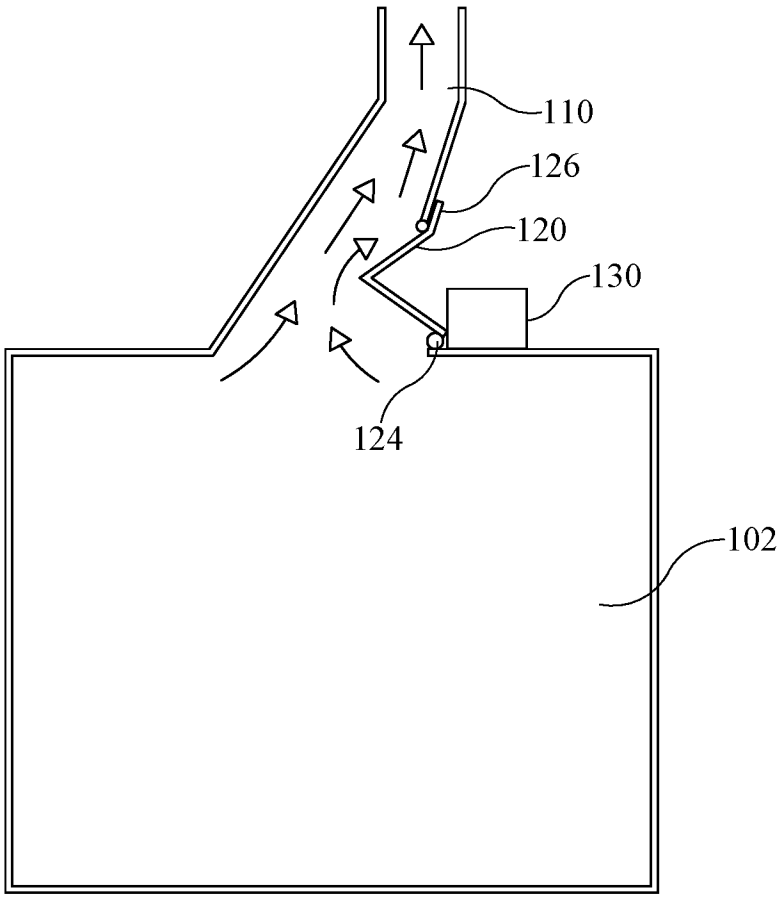
FIG. 6 is side view of a variable flow vent assembly in accordance with some aspects and embodiments.

Referring now to FIGS. 7 and 8 and in accordance with some embodiments an articulating damper 120 may be installed in a portion of vent 110 such that damper 120 protrudes into vent 110 when moved by actuator 130. In the embodiments depicted in FIGS. 7 and 8 articulating damper 120 has a stop portion 126 that contacts vent 110 when damper 120 is completely closed. Articulating damper is rotatable around axis 124 such that, when fully "closed" damper 120 protrudes as far as possible into vent 110 to restrict airflow.

In operation, system 10 utilizes a suitable instruction set for processor 202 to control damper 120 (or dampers 120 depending upon the configuration of oven 100) depending on the specific task being performed by oven 100. The oven operating characteristics are known by inputs 220 to controller 200 and therefore damper 120 position can be carefully selected based upon those characteristics. In some exemplary embodiments controller 200 has a plurality of inputs 220 operatively coupled thereto that are representative of oven function (bake, broil, convection, clean) and oven temperature that represent all the various combinations of use of oven 100. In one embodiment, when controller 220 senses that lower oven 102 has been set to "bake" controller 200 provides an output 210 to the lower oven 102 vent 110 damper 120 to actuate it to the fully open position for a predetermined time period to aid in starting the oven 102 burner. Once the predetermined time period expires controller 200 then provides an output 210 to damper 120 actuator 130 to move damper 120 to a preset position required for the oven temperature desired.

In other embodiments, when oven 102 is in use and oven 102 burner cycles "off"—indicating that preset temperature has been reached, controller 200 actuates lower oven 102 damper 120 to close it to a predetermined minimum position, thereby reducing the heat loss through damper 120 and prolonging the "off" cycle. Once the oven 102 burner reignites damper 120 is then returned to its normal open position.

In yet another aspect of the invention controller 200 provides a predetermined damper 120 position when oven 102 is in the "broil" mode of operation. In another embodiment when oven 102 is being used in convection mode, controller 200 moves damper 120 to a predetermined reduced open or minimum position when oven 102 burner is off and the convection fan is on. In a similar fashion, controller 200 may actuate damper 120 to a predetermined minimum open position when oven 102 is in self clean operation, but the burner is off.

In some aspects and embodiments oven 102 may include variable valves that control the bake and broil burners, and thus the amount of heat supplied by these burners during oven operation. In conventional ovens 102 wherein the bake and broil burners operate only in "full on" or "full off" modes, the burners simply cycle on an off to control temperature in oven 102. However, in variable valve ovens the bake and broil burners may be operated at a low or reduced gas flow rate, thereby supplying only the heat necessary to maintain oven 102 at temperature. When used with variable valve ovens 102, vent damper 120 may be optimized to provide a vent position that maximizes oven 102 efficiency.

In one exemplary but non-limiting embodiment, oven 102 may be equipped with a bake burner that operates from a minimum of 12,000 BTU/hr up to 18,000 BTU/hr in Natural gas. Utilizing variable vent damper 120, controller 200 operates to optimize the vent 110 effective opening size by providing a damper 120 position for the exact gas flow rate commanded. In some embodiments damper 120 may be fully opened to heat oven 102 to a preheat temperature, and then controller 200 reduces damper 120 to a predetermined position based on the position of oven 102 burner. This feature of the invention also facilitates control of oven 102 cycle times, since changing the burner rate lengthens or shortens the "on time" for oven 102 while changing the vent 110 damper 120 position lengthens or shortens the "off time" of oven 102.

Figure 11:
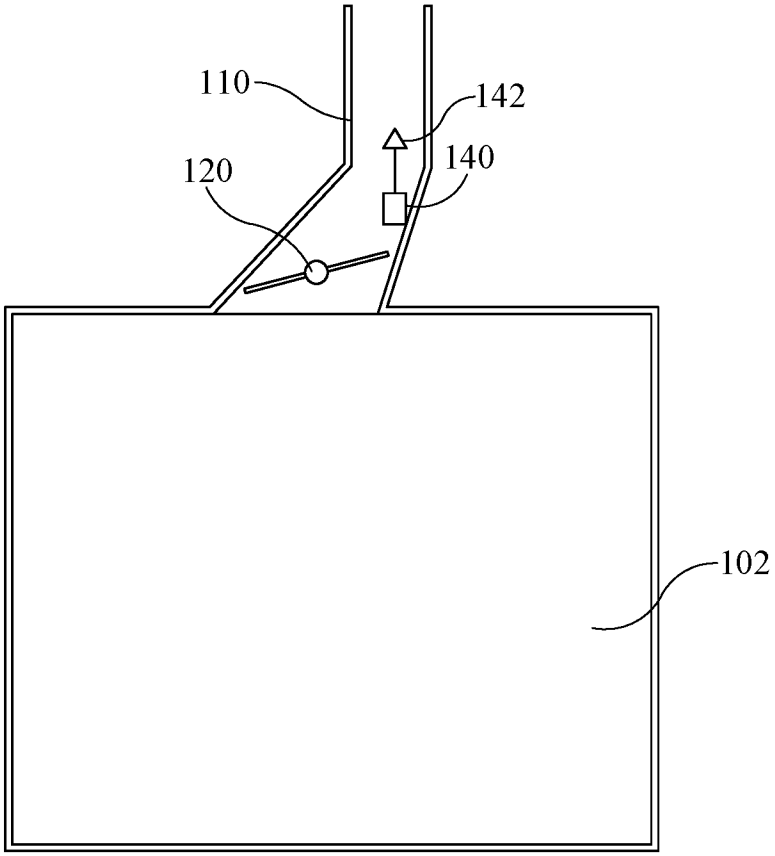
FIG. 11 is a side view of a variable flow vent assembly in accordance with some aspects and embodiments.

In a yet further embodiment of the invention as depicted in FIG. 11, a temperature sensor 140 may be placed or positioned in vent 110 to determine the temperature of exhaust gasses exiting oven 102. Temperature sensor 140 may be one of many known devices capable of sensing temperature, such as a thermocouple or RTD device. Furthermore, temperature sensor 140 may provide an output 142 representative of exhaust gas temperature operatively coupled to an input 220 of controller 200. In this embodiment controller 200 can determine what oven 102 operation is being performed based on exhaust gas temperature and adjust damper 120 position responsive thereto. In one exemplary embodiment, when oven 102 is operated in broil mode the exhaust gas temperature will be substantially higher than in other modes of operation. Once a predetermined temperature representative of a broil burner operation is detected by sensor 140, controller 200 may actuate damper 120 to a predetermined open position to accommodate this oven 102 operation. Similarly, exhaust gas temperatures consistent with "bake", "preheat" and "warm" operations may be determined and controller 200 may be provided with suitable instructions to actuate damper 120 to predetermined positions once these operational modes are detected.

Figure 12:
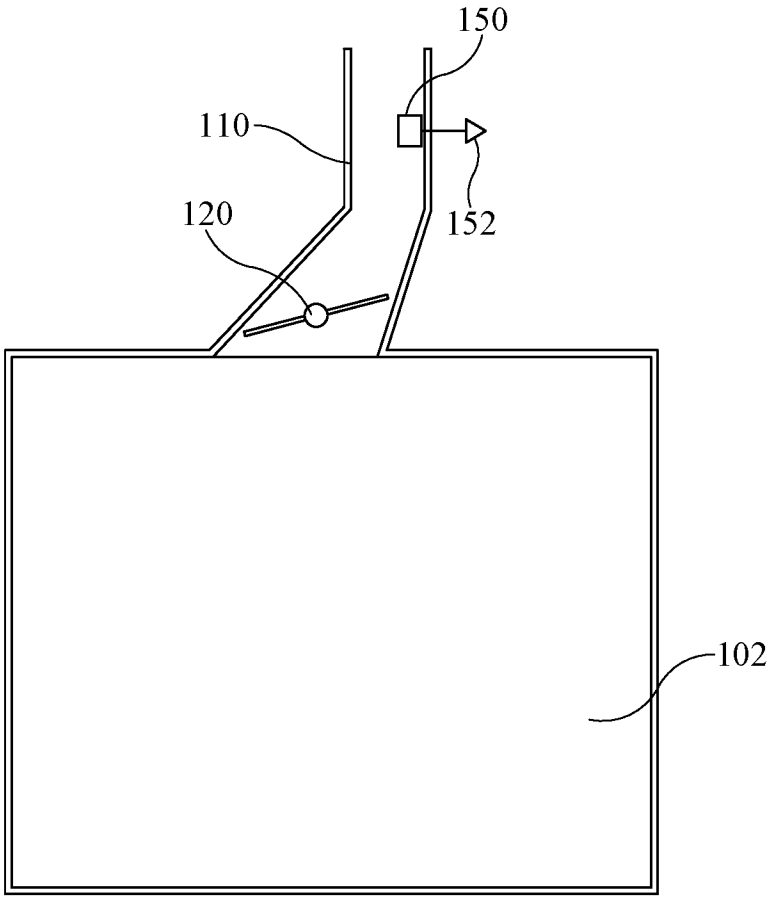
FIG. 12 is a side view of a variable flow vent assembly in accordance with some aspects and embodiments.

Referring now to FIG. 12 and in accordance with a further embodiment, a CO or CO2 gas sensor 150 may be placed or positioned in vent 110 to determine the CO or CO2 composition of the exhaust gasses exiting oven 102. Gas sensor 150 may be one of many known devices capable of sensing carbon dioxide or carbon monoxide, for example, infrared type CO and CO2 detectors. Furthermore, gas sensor 150 may provide an output 152 representative of gas concentration operatively coupled to an input 220 of controller 200. In some aspects and embodiments a plurality of gas sensors 150 may be used, for example one to measure CO2 and one to measure CO. In these embodiments, CO2 concentration and CO concentration may be utilized by processor 200 to determine "air free" CO. This "air free" CO determination is necessary for natural gas burning appliances since safety certifications rely on it to determine safe operation.

In the aforementioned example, when processor 200 determines "air free" CO to be in excess of a predetermined maximum, damper 120 is actuated to provide more air venting to oven 102, thereby improving combustion. In some embodiments damper position 120 can be optimized by controlling damper 120 position to control "air free" CO to a predetermined set point.

In a yet further embodiment, when a gas concentration above a predetermined maximum is sensed by gas sensor 150, as indicated by output 152, controller 200 is provided with instructions to actuate damper 120 to a predetermined open position, thereby enhancing combustion in oven 102.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A gas oven, comprising:

an oven cavity including an exhaust vent;

a carbon dioxide sensor positioned in the exhaust vent and having an output representative of carbon dioxide concentration in the exhaust vent;

a carbon monoxide sensor positioned in the exhaust vent and having an output representative of carbon monoxide concentration in the exhaust vent;

a broil gas burner disposed proximate at top of the oven cavity;

a bake gas burner disposed proximate a bottom of the oven cavity;

a movable damper in fluid communication with the exhaust vent, the damper capable of being moved to restrict or enhance air flow through the exhaust vent;

an actuator operatively secured to the movable damper for providing motion thereto; and a controller having a processor and concomitant data memory, the controller having a plurality of inputs and outputs for receiving and providing electrical signals to a plurality of electrical components of the gas oven, wherein the controller provides an output to the actuator representative of a desired damper position for a desired oven operating characteristic, and wherein the controller is further configured to, during a cycle using one of the broil gas burner and the bake gas burner, actuate the damper responsive to at least one of the output of the carbon dioxide sensor and the output of the carbon monoxide sensor.

2. The gas oven of claim 1, wherein the cycle is a first cycle, and wherein the controller is further configured to, during a second cycle using one of the broil gas burner and the bake gas burner:

control the output to the actuator to place the damper in a first predetermined open position to aid in starting the one of the broil gas burner and the bake gas burner;

after starting the one of the broil gas burner and the bake gas burner, control the output to the actuator to place the damper in a second predetermined open position that is more restricted to air flow than the first predetermined open position; and after turning off the one of the broil gas burner and the bake gas burner during the second cycle, control the output to the actuator to place the damper in a third predetermined open position that is more restricted to air flow than the second predetermined open position to reduce heat loss through the exhaust vent.

3. The gas oven of claim 2, wherein the damper comprises at least one rotatable plate that is capable of rotation around a central axis.

4. The gas oven of claim 2, wherein the damper comprises a plurality of louvers that are capable of rotation around a central axis.

5. The gas oven of claim 2, wherein the damper comprises an articulating damper that is capable of extension and retraction into and out of the exhaust vent.

6. The gas oven of claim 2, wherein the controller is configured to control the output to the actuator to place the damper in the second predetermined open position based upon a desired temperature set point.

7. The gas oven of claim 2, wherein the first predetermined open position is a maximum open position.

8. The gas oven of claim 2, wherein the third predetermined open position is a minimum open position.

9. The gas oven of claim 2, wherein the second cycle is a convection cycle.

10. The gas oven of claim 2, wherein the second cycle is a self-clean cycle.

11. The gas oven of claim 2, wherein the one of the broil gas burner and the bake gas burner used in the second cycle is controlled by a variable valve, and the controller is further configured to determine a position of the variable valve within a range of positions and generate an output to the actuator based at least in part on the determined position of the variable valve, and wherein the controller is configured to generate the output to the actuator based at least in part on the determined position of the variable valve to optimize oven efficiency when the variable valve is in the determined position.

12. The gas oven of claim 1, wherein the controller is provided with instructions to monitor carbon dioxide and monoxide concentrations and determine an air free carbon monoxide concentration, and wherein the controller is configured to actuate the damper responsive to at least one of the output of the carbon dioxide sensor and the output of the carbon monoxide sensor by actuating the damper responsive to the determined air free carbon monoxide concentration.

13. The gas oven of claim 1, wherein the controller is configured to actuate the damper responsive to at least one of the output of the carbon dioxide sensor and the output of the carbon monoxide sensor by actuating the damper responsive to a carbon monoxide concentration.

14. The gas oven of claim 1, wherein the controller is configured to actuate the damper responsive to at least one of the output of the carbon dioxide sensor and the output of the carbon monoxide sensor by actuating the damper responsive to carbon monoxide and carbon dioxide concentrations.

15. The gas oven of claim 1, wherein the controller is configured to actuate the damper responsive to at least one of the output of the carbon dioxide sensor and the output of the carbon monoxide sensor by actuating the damper responsive to predetermined air free carbon monoxide set points.

16. The gas oven of claim 1, wherein the one of the broil gas burner and the bake gas burner is controlled by a variable valve.

* * * * *